US005083251A

United States Patent [19]

Parker

[11] Patent Number: 5,083,251

[45] Date of Patent: Jan. 21, 1992

[54] TRANSITION ILLUMINATION LAMP

[76] Inventor: Robert Parker, 411 Rolling Hills La., Alamo, Calif. 94507

[21] Appl. No.: 612,581

[22] Filed: Nov. 13, 1990

[51] Int. Cl.[5] ..... F21V 9/10

[52] U.S. Cl. ..... 362/255; 362050824143/293; 362050824143/351

[58] Field of Search ..... 362/255, 293, 351; 313/112, 117; 350/353

[56] References Cited

U.S. PATENT DOCUMENTS

| | | | |
|---|---|---|---|
| 3,256,518 | 6/1966 | Crane | 350/353 |
| 3,470,049 | 9/1969 | Reusch | 350/353 |
| 3,584,934 | 6/1971 | French | 350/353 |
| 3,642,280 | 3/1972 | Jacobs | 340/815.01 |
| 4,772,506 | 9/1988 | Siol et al. | 350/353 |
| 4,832,466 | 5/1988 | Nishimura et al. | 350/353 |
| 4,954,937 | 9/1990 | Kobayashi et al. | 362/255 |

*Primary Examiner*—Ira S. Lazarus
*Assistant Examiner*—Richard R. Cole
*Attorney, Agent, or Firm*—Renner, Otto, Boisselle & Sklar

[57] ABSTRACT

A transition illumination lamp device comprising a light source which produces light and heat, and a thermochromic layer positioned with respect to the light source to control the quantity of light transmitted from the device as a function of the temperature and time of the thermochromic layer, such temperature being a function of the heat produced by the light source and the transition temperature of the thermochromic layer.

19 Claims, 2 Drawing Sheets

TRANSITION ILLUMINATION LAMP

FIELD OF THE INVENTION

The present invention relates to a device for variably controlling the optical properties of a source of light as a function of temperature and time, and, more particularly, to a device for controlling the intensity and/or chromatic properties of light emitted from a light source, e.g., a light bulb, as a function of temperature of the device and time.

BACKGROUND OF THE INVENTION

Man-made sources of radiant light have been known since the nineteenth century. A few examples of those currently available are incandescent, fluorescent and halogen lights. When electrical current is supplied to these devices, they convert electrical energy into thermal energy and radiant light, thus illuminating the surrounding area.

Typically, the response time of these light sources to a supply of electrical current is very rapid, so rapid, in fact as to appear instantaneous to the human eye. In other words, upon turning or flipping a light switch the light source appears to achieve its full brightness immediately. Often times, however, this is undesirable or unpleasant. The human eye adapts to the ambient light around it so as to permit vision in a variety of different lightings. In bright light the iris of the eye contracts, as does the aperture of a camera, to allow a relatively small amount of the ambient light to pass through and to reach the retina. In a darker environment the iris opens to allow a greater amount of ambient light to pass through and to reach the retina, thus allowing a person to see objects in relatively dark environments. The response time of the iris to changes in the amount of ambient light varies among people, and generally grows longer as a person grows older. Thus older people tend to be very sensitive to quick changes in light.

A person's sensitivity to light is increased as the instantaneous increase in brightness is increased, as it requires a greater amount of change for the iris to adjust to the increased amount of ambient light present. Thus, a person is especially sensitive to bright light immediately upon awaking in the morning (the iris having been protected by closed eyelids), or upon turning on a light in a previously dark room (the iris having been relatively wide open to try to enable the sight function), it often taking several seconds, e.g., about 3–15 seconds, for the iris to adjust completely. Consequently, when turning on a bathroom or bedside light at 2:00 am after waking from sleep, the sudden brilliance of the light can be quite uncomfortable. Infants are also quite sensitive to bright light, even with their eyelids closed. Consequently, turning on a light, such as in a nursery, often will wake an infant from sleep.

In some instances the almost immediate response time of a light source can even be dangerous. Take, for example, the overhead or reading lamp in a car. When the driver turns on the light in the relative darkness of night to examine a map, for instance, within the car, the sudden intense brightness in stark contrast to the surrounding environment can temporarily blind the driver, thus preventing the driver from easily seeing oncoming cars, traffic signs, or changes in the course of the road.

It would be desirable to provide a device for controlling the intensity of light produced by a lamp in a way to gradually increase the intensity as a person's eyes became accustomed to the light in an inexpensive manner.

SUMMARY OF THE INVENTION

The present invention provides a means for controlling the intensity and/or chromatic character (e.g., color) of light emitted to the environment by a light source as a function of temperature and time. In one embodiment the light source appear to transmit a relatively small amount of light immediately after being turned on and then gradually brightens over a period of time. Preferably the period of time for the light source to brighten approximately coincides with the amount of time that it takes for the human eye to adjust to the increasing light intensity. In another embodiment there is a color change over a period of time after the light source is turned on, and in a further embodiment both intensity and color change over the indicated time period.

According to one aspect of the invention, a transition illumination lamp device includes a light source which produces light and heat, and a thermochromic layer positioned with respect to the light source to control the quantity of light transmitted from the device as a function of the temperature of the thermochromic layer, such temperature being a function of its temperature.

According to another aspect of the invention, a temperature responsive lamp includes a light source for producing light and heat; and thermochromic means for selectively blocking, transmitting, or partially transmitting light produced by the light source as a function of the heat produced by the light source.

According to a further aspect, the invention relates to a temperature responsive lamp including a light source for producing heat and light, and thermochromic means for transmitting light, the color of which is a function of the heat produced by light source.

According to still another aspect, the invention relates to a thermochromic jacket adapted to be placed about at least part of a light source, the jacket containing thermochromic material, whereby the jacket controls the quantity of light transmitted therethrough as a function of its temperature.

According to a further aspect of the invention, a lamp includes a light source for producing heat and light, and thermochromic means in optical series with the light source for controlling the intensity of light transmitted therethrough as a function of temperature of the thermochromic means; whereby the light produced by the light source (or at least a wavelength of light) is substantially blocked by the thermochromic means immediately after the light source is energized and is transmitted at an increasing intensity through the thermochromic means as the light source remains energized and the thermochromic means changes temperature.

According to still a further aspect of the invention, a method of making a thermochromic device includes the step of applying a thermochromic material to a substantially transparent surface of a light source.

According to another aspect of the invention, a strand of ornamental lights including a plurality of temperature responsive lamps including light source means for producing heat and light, and thermochromic means for transmitting light, the color of which is a function of the heat produced by such light source means and time, and a plurality of conductors for supplying electrical energy to the plurality of temperature responsive lamps. The strand of ornamental lights may also include means for alternatingly enabling and interrupting the supply of electrical energy along the plurality of conductors so that the plurality of temperature responsive lamps cool when the supply of electrical energy is interrupted and are operative to transmit colored light, the color of which changes over time, while the supply of electrical energy is enabled.

These and other objects, advantages, features and aspects of the present invention will become apparent as the following description proceeds.

To the accomplishments of the foregoing and related ends, the invention, then comprises the features hereinafter fully described in the specification and particularly pointed out in claims, the following description and the annexed drawings setting forth in detail a certain illustrative embodiment of the invention, this being indicative, however, of but one of the various ways in which the principals of the invention may be employed. It will be appreciated that the scope of the invention is to be determined by the claims and the equivalents thereof.

DETAILED DESCRIPTION OF THE INVENTION

Figure 1:
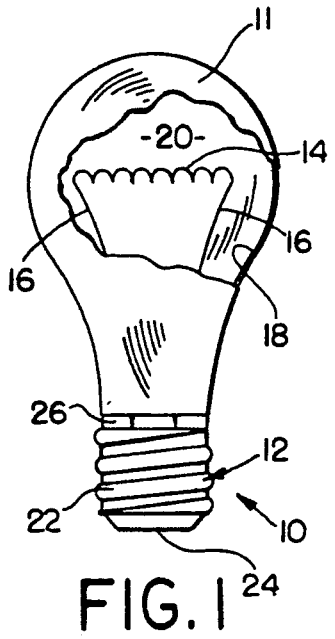
FIG. 1 is an illustration of an incandescent light bulb including a thermochromic material (partly broken away for illustration purposes) deposited upon a majority of the glass envelope in accordance with the present invention.

With reference to the several figures in which like reference numerals depict like items, and initially to FIG. 1, there is illustrated an exemplary incandescent light bulb 10 having a thermochromic layer or coating 11 in accordance with the present invention. The light bulb 10, as is conventional, includes a conductive base 12 for securement to a light fixture for the supply of electrical current, a filament 14 attached to the base 12 through a pair of relatively rigid conductive elements 16, and a glass envelope 18 attached to the base 12 for containing the filament 14 within a nonreactive environment 20. The base 12 includes at least two electrically conductive portions 22, 24 electrically isolated from one another. Each conductive portion 22, 24 is electrically connected to a respective element 16. Consequently, when the conductive portions 22, 24 are in contact with a supply of electrical current, the current will flow through the elements 16 and the filament 14. Typically the filament 14 is a resistive element constructed of a tightly coiled tungsten alloy or other suitable material that, upon the supply current, quickly reaches a very high temperature thus radiating heat and light.

The thermochromic coating 11 may be any of a variety of material which change their optical properties as a function of their temperature. A preferred thermochromic material will have optical characteristics so as to appear relatively opaque below a certain temperature and gradually to become optically transmissive above that temperature as heating occurs. Thermochromic materials exhibiting such optical characteristics are well known in the art and readily commercially available. Suitable thermochromic materials are manufactured by Matsui International Co., Inc. Exemplary materials and the characteristics thereof are presented in Chart I below.

TEMPERATURE CHART I
CHROMIC COLOR CHANGING REGULAR TYPE

| MATERIAL TYPE # | COLOR CHANGING TEMPERTURE RANGE | | | |
|---|---|---|---|---|
| | COLOR APPEARS | | COLOR DISAPPEARS | |
| 025 | Below −25° C. | or −13.0° F. | Over −15° C. | or 5.0° F. |
| 015 | −13 | 8.6 | 0 | 32.0 |
| 07 | −4 | 24.8 | 5 | 41.0 |
| 5 | 1 | 33.8 | 12 | 53.6 |
| 10 | 8 | 46.4 | 16 | 60.8 |
| 15 | 11 | 51.8 | 19 | 66.2 |
| 17* | 14 | 57.2 | 23 | 73.4 |
| 20* | 16 | 60.8 | 26 | 78.8 |
| 25 | 22 | 71.6 | 31 | 87.8 |
| 27* | 24 | 75.2 | 33 | 89.6 |
| 35* | 27 | 80.6 | 36 | 96.8 |
| 37 | 32 | 91.4 | 41 | 109.4 |
| 45 | 40 | 104.0 | 50 | 122.0 |
| 47 | 44 | 111.2 | 58 | 136.4 |

*Standard Types

These thermochromic materials are disposed in a binding medium which when cured or hardened will contain the thermochromic material in a fixed position relative to a surface. The binding materials are chosen to be transparent, and preferably clear. As stated above, the thermochromic material may be chosen to be opaque, and preferably black, below a certain temperature. The combination of the binder and the thermochromic material thus will appear relatively black and optically nontransmissive below a certain transition temperature, and relatively clear or optically transmissive above that temperature. However, it may be desirable to tint the binding material a prescribed color, so as to transmit color light in its optically transmissive state, or it may be desirable to employ a thermochromic material that is other than black in its relatively opaque state, for example, red, green, yellow or blue. It may further be desirable to use combinations of different types of microencapsulated thermochromic material operating over the same or different temperature ranges to provide various operational effects, as will be evident to those having ordinary skill in the art in view of the description hereof. The combined binder and thermochromic materials are applied to a majority of the outer envelope 18 of the incandescent light bulb preferably through a conventional dipping or spraying process although other methods such as by electrostatic coating may be used. Alternatively, the thermochromic material and binding medium may be deposited upon the inside surface of the light bulb envelope 18 such as by using a spraying or coating process.

In operation when an electrical current is applied to the light bulb 10, the filament 14 will become very hot and begin to radiate heat and light. Assuming that the bulb was at room temperature before the current was applied, and that the thermochromic coating 11 is opaque at room temperature, a substantial portion of the light generated by the filament 14 will be blocked by the thermochromic coating 11. Consequently, upon turning on the light bulb only a small portion of the light generated by the filament 14 will actually be radiated to the room. The amount of light to be radiated when the light bulb is initially turned on may be regulated by the density of the thermochromic material contained with the coating 11, the thickness of the coating 11, and/or other characteristics of the coating and thermochromic material thereof.

Also, if desired, areas of the glass envelope 18 of the light bulb may be left uncoated and thus be completely optically transmissive, such as the area indicated at 26 in FIG. 1. By controlling the amount of the envelope 18 left uncoated, the amount of light radiated to the environment upon initially turning on the light bulb may be controlled. Further, the areas of a light bulb to be left uncoated may be chosen such as to provide directional or indirect lighting. For example, the remote bottom or top portions of the envelope 18 or one or more small areas may be left uncoated, whereby light will be projected predominantly upwardly, downwardly or in a preferred direction, and generally not directed into the eyes of a person turning on the light.

Figure 2:
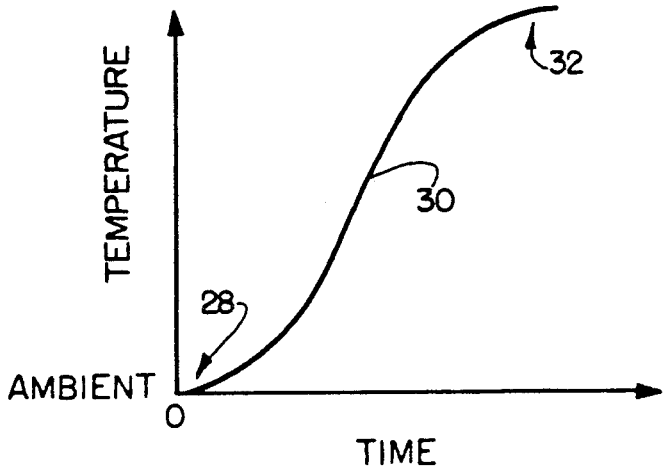
FIG. 2 is a graphical representation of a temperature versus time curve illustrating the gradual heating of a light bulb when electrical current is applied.

As the filament 14 creates heat as well as light, the heat reaching the glass envelope 18 will cause it to warm over time until it reaches a steady state temperature. The steady state temperature is a function of the wattage of the bulb as well as the surface area of the glass envelope and the temperature of the surrounding environment. Referring to FIG. 2, there is shown a time versus temperature curve for the glass envelope 18 and thermochromic coating 11 of a representative bulb. As described herein it is assumed that the glass envelope 18 and the thermochromic coating 11 are at the same temperature. However, it will be recognized that there may be a slight thermal gradient between the envelope and the coating. In the figure temperature is represented on the vertical axis and time is represented on the horizontal axis. As can be seen, immediately when the light is turned on, which is represented by the point furthest toward the left on the graph, the temperature of the thermochromic coating 11 is at ambient temperature. As time progresses, the temperature of the thermochromic coating 11 will rise following the curve 30 until it reaches its steady state condition which is generally indicated at 32. At steady state condition the temperature of the thermochromic coating will level off as the rate of heat transferred from the filament 14 to the coating 11 is the same as that from the coating 11 to the ambient environment.

Figure 3:
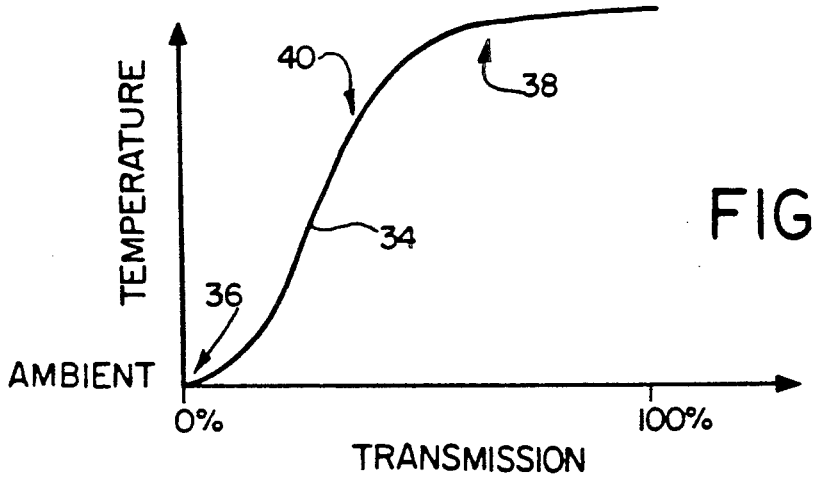
FIG. 3 is a graphical representation of a temperature versus light transmission curve of a sample thermochromic material.

Referring now to FIG. 3, a temperature versus transmission curve is shown for the thermochromic material used in FIG. 2. Temperature is again represented on the vertical axis and transmission of light through the thermochromic coating represented on is the horizontal axis. Temperature of the thermochromic coating 11 and the transmission of light through the coating are a function of the curve 34. One exemplary suitable thermochromic material used in the coating will exhibit approximately zero percent transmission and will appear opaque at ambient temperature as indicated by the area of the curve 34 denoted by the reference numeral 36. As the temperature of the coating and thermochromic material increases toward steady state, the light transmission through the coating will gradually increase following the curve 34 eventually approaching substantially 100% at the steady state temperature 38. Preferably, the thermochromic material is chosen such that at the ambient temperature range of a typical room the thermochromic material appears opaque or nontransmissive, yet it reaches close to 100% transmission at or before the typical steady state temperature that the coating is expected to reach on the energized light bulb. As the temperature of the coating is related to the time from turning on the light bulb as illustrated in FIG. 2 by the curve 30, the transmissive response time of the device can be slowed by choosing materials which would shift the curve 34 toward the left in FIG. 3, or material could be chosen with faster response time which would shift the curve towards the right.

Figure 4:
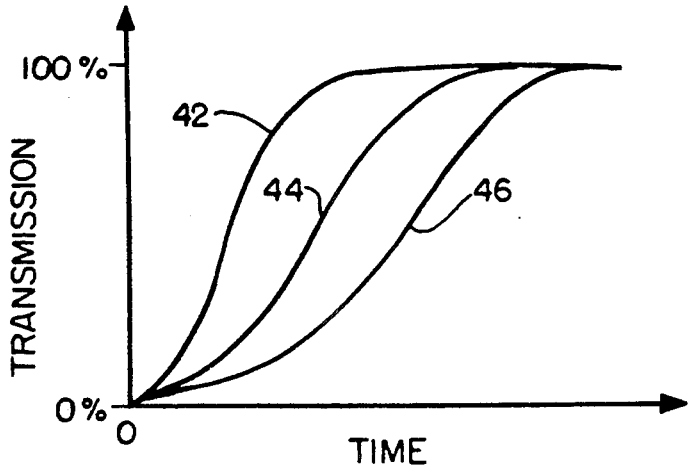
FIG. 4 is a graphical representation of the transmission versus time curves for three thermochromic material when heated by an incandescent bulb.

The transmission versus time curves for three different thermochromic materials are illustrated in FIG. 4. In FIG. 4, transmission is represented on the vertical axis and time is represented on the horizontal axis. Transmission versus time curves for thermochromic materials having transition temperatures of 40° C., 50° C. and 60° C. are shown in the figure by the curves 42, 44 and 46, respectively. The transition temperature of a thermochromic material is the temperature at which the material undergoes the greatest amount of change from opaque to transmissive. However, it will be recognized that the material undergoes a lesser degree of change over a broad temperature range encompassing the transition temperature.

As can be seen from FIG. 4, the thermochromic material having a transition temperature of 40° C. becomes progressively more transmissive relatively faster than the thermochromic materials having higher transition temperatures. Consequently, by knowing the temperature versus time curve of the envelope of the light bulb a shown in FIG. 4, one can choose an appropriate thermochromic material which will proceed from its opaque to transmissive states at the proper rate. As would be evident, for a higher wattage bulb which would generally heat up more rapidly than a lower wattage bulb of the same envelope size, to maintain a gradual brightening of the transmitted light a thermochromic material having a higher transition temperature would be chosen. It will also be noted from the figures that the transition from opaque to transmissive states is not instantaneous but rather gradual as indicated by the curves..

Consequently, when the light bulb is turned on only a small amount of light will be actually transmitted to the ambient temperature, or the room, and as the coating heats up over time and gradually becomes fully transmissive, substantially all light emitted by the filament will be transmitted into the room thus allowing a person's eyes to adjust to the increasing light intensity in the room. Typically, a thermochromic coating which progresses from opaque to fully transmissive within three to fifteen seconds after the light bulb is turned on will be adequate to allow a person's eyes to adjust comfortably to the increasing intensity of the light in the room.

It is also possible to chose a thermochromic material for the coating that when cool transmits a certain color light and upon becoming heated gradually brightens to transmit white light. A number of such thermochromic materials may be microencapsulated and combined in the coating to yield a light bulb that transmits different colors as it heats up. For example, for a light bulb with a coating containing a thermochromic material which changes from black to transmissive at 45° C., green to transmissive at 50° C., and from yellow to transmissive at 60° C., the emitted light would appear black at a low temperature. As the light bulb and thermochromic material become hotter, the emitted light would gradually become green and, in response to further heating the emitted light would gradually become yellow and then eventually clear, or white.

Figure 5:
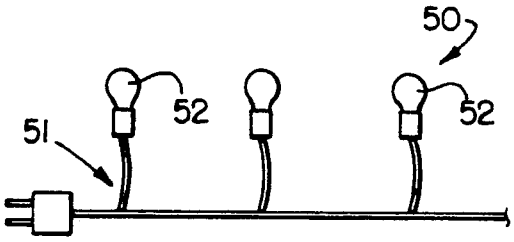
FIG. 5 is a schematic illustration of an embodiment of the invention employing a strand of lights including a thermochromic material deposited on the individual bulbs.

An application for such multicolor type of thermochromic coating may be in Christmas tree lights, for example, which are schematically shown at 50 in FIG. 5. When employed in connection with several strands 51 of lights 52 wherein each strand selectively is turned on or off, when a strand is turned on the individual lights thereof would continuously move through their color changes to white as the lights remain on. When the strand is turned off, the lights thereof will then cool down to be prepared once again to go through the color changes when turned back on. Also, if desired, different bulbs in a strand may have different thermochromic coatings to present different color sequences or to preset color sequences at different times.

Figure 6:
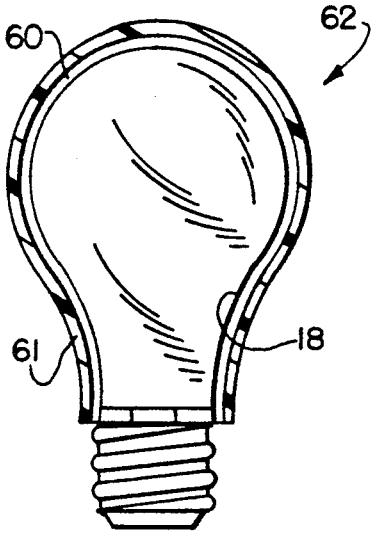
FIG. 6 is an illustration of an incandescent bulb having a colored transmissive coating and a thermochromic coating in optical series.

In another embodiment, the binding material containing the thermochromic material may be tinted so as to transmit a certain color light when the bulb is in its transmissive state. Alternatively, as is shown in FIG. 6, there may be a first selectively transmissive coating 60 applied to or about the envelope 18 of a light bulb, e.g., to transmit yellow light, and a thermochromic coating 61, as well. The thermochromic coating 61 may be "upstream" or "downstream" to the light emission direction relative to the coating 60. Such a light source 62 would have a usage in dark room applications, for example wherein the light gradually progresses from opaque to yellow as the bulb heat up.

Figure 8:
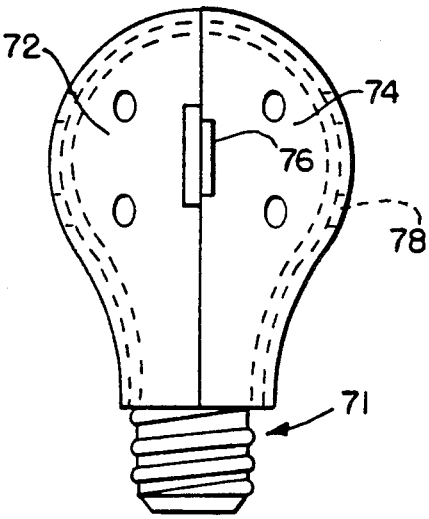
FIG. 8 is an illustration of the thermochromic jacket of FIG. 7 shown enclosing an incandescent light bulb.
Figure 7:
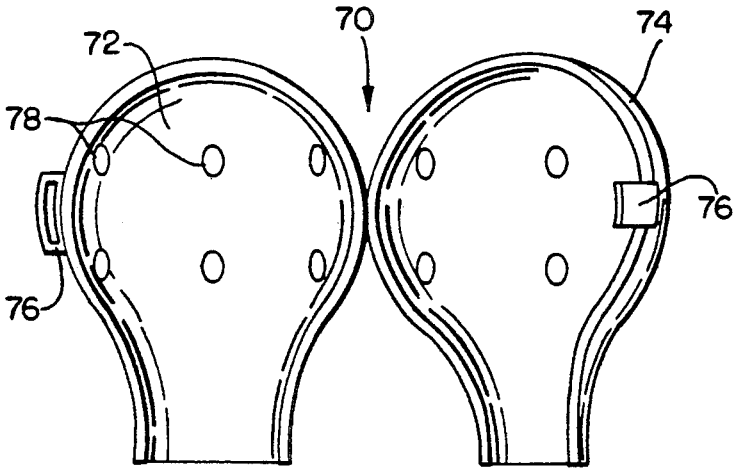
FIG. 7 is an illustration of a hinged thermochromic jacket shown in an open position.

Referring now to FIGS. 7 and 8, there is shown a thermochromic jacket 70 adapted to be placed around a light bulb 71. The jacket 70 is preferably configured as two halves, 72, 74 hinged at one location around its circumference and provided with a latching means 76 opposite the hinge. The halves 72, 74 of the jacket 70 may be provided with interior standoffs 78 integrally formed or otherwise mounted to the internal surfaces of the halves. The standoffs maintain a space between the outer surface of the light bulb envelope and the jacket. The thermal gradient across the air space prevents the jacket from reaching the very high temperatures of the light bulb glass envelope. The jacket, if spaced away from the glass envelope, may be used to slow the response time of the composite device and also to prevent possible thermal degradation of the thermochromic material by keeping it at a lower temperature. The space between the outer surface of the light bulb envelope and the jacket may also aid in cooling the jacket once the light bulb is turned off due to air flow within the space.

The jacket is preferably constructed of a suitable plastic material that can be easily vacuum formed into the appropriate shape. The thermochromic material is applied to the plastic material, such as by silkscreening or microencapsulated thermochromic material may be mixed with a transparent film to form a composite film well suited for vacuum forming. After the thermochromic material or film has dried or cured, the resultant film is then heated and vacuum formed upon a mold having the shape of the jacket or a portion thereof. The jacket could also be formed using other methods, such as the injection molding of a plastic having the thermochromic material disposed therein or applied to the cooled part later.

In operation the thermochromic jacket will control the intensity of light transmitted to the ambient environment in the same manner as the light bulb with the thermochromic material applied directly to the envelope, as discussed above relative to FIG. 1. In fact, while the jacket is relatively cooler than would be a coating applied to the envelope of the same light bulb, the jacket can be made to transition from opaque to clear with the same approximate time span as the coating by choosing for use with the jacket a thermochromic material having a lower transmission temperature than that of the coating.

One advantage of the thermochromic jacket embodiment is that it may be installed on the desired light source by the consumer directly. Further, the jacket can be easily moved to a different light source, or removed to replace a burned-out bulb and then installed on a new bulb.

Figure 9:
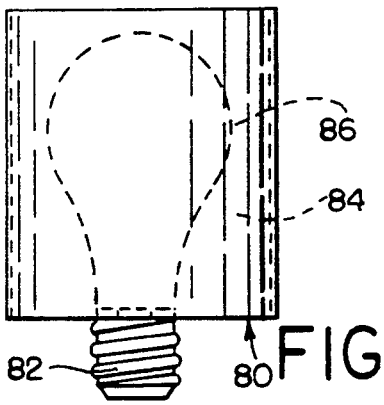
FIG. 9 is an illustration of a cylindrical thermochromic jacket surrounding an incandescent bulb.

In another embodiment, a thermochromic jacket 80 may also be formed as a cylinder adapted to axially encompass a light bulb 82, as shown in FIG. 9. The cylindrical jacket 80 will function as discussed above relative to the jacket 70 depicted in FIGS. 7 and 8, however, the cylindrical jacket 80 may be configured to allow the diameter of the cylinder to be easily changed. As the diameter is changed, for the same bulb size, the air gap 84 between the bulb envelope 86 and the jacket 80 will change, thus allowing the optically responsive characteristics, namely the response speed, of the jacket 80 to be adapted to specific conditions and users.

While the invention is described above in connection with an incandescent light bulb, it will be appreciated by one skilled in the art that the invention could be employed in connection with any type of light source which produces heat as well as light, and further that all such uses are within the scope of the present invention.

What is claimed is:

1. A thermochromic jacket adapted to be placed around a light source, said jacket consisting essentially of a material containing thermochromic material disposed throughout; whereby said jacket controls the quantity of light transmitted therethrough as a function of the temperature of said light source.

2. The transition illumination lamp device of claim 1, wherein said jacket is constructed as two halves for facilitating placement around a light source.

3. The transition illumination lamp device of claim 2, wherein said halves are hinged.

4. The transition illumination lamp device of claim 1, wherein said jacket further controls the color of light transmitted therethrough as a function of the temperature of the jacket.

5. A transition illumination lamp device comprising: light source means for producing light and heat, said light source means including a substantially transparent envelope; and a thermochromic layer in contact with said envelope, said thermochromic layer controlling the quantity of light transmitted from the device as a function of the temperature of said thermochromic layer, such temperature being a function of the heat produced by said light source means and time.

6. The transition illumination lamp device of claim 5, wherein said thermochromic layer is a film.

7. The transition illumination lamp device of claim 5, wherein said thermochromic layer is a coating applied to said envelope.

8. A transition illumination lamp device comprising light source means for producing light and heat, and a thermochromic layer positioned with respect to said light source means to control the quantity of light transmitted from the device as a function of the temperature of said thermochromic layer, such temperature being a function of the heat produced by said light source means and time, said thermochromic layer including microencapsulated thermochromic material in a binder material, said binder material being tinted to transmit colored light.

9. A transition illumination lamp device comprising light source means for producing light and heat, and a thermochromic layer positioned with respect to said light source means to control the quantity of light transmitted from the device as a function of the temperature of said thermochromic layer, such temperature being a function of the heat produced by said light source means and time, said thermochromic layer being substantially opaque at the ambient temperature range of the environment in which said device will be used.

10. The transition illumination lamp device of claim 9, wherein said thermochromic layer transitions from substantially opaque to substantially transparent at a certain temperature above such ambient temperature range.

11. The transition illumination lamp device of claim 10, wherein such transition is gradual with respect to time.

12. A temperature responsive lamp, comprising light source means for producing light and heat; and thermochromic means for selectively substantially blocking, transmitting, or partially transmitting light produced by said light source means as a function of the heat produced by said light source means and time, said thermochromic means substantially blocking such light at the ambient temperature range in which the lamp is used.

13. The lamp comprising:

light source means for producing heat and light, and thermochromic means in optical series with said light source means for controlling the intensity of light transmitted therethrough as a function of temperature of said thermochromic means; whereby the light produced by said light source means is substantially blocked by said thermochromic means immediately after said light source means is energized an is transmitted at an increasing intensity up to a maximum through said thermochromic means as said light source means remains energized.

14. A method of making a thermochromic device; comprising the steps of applying a thermochromic material to a substantially transparent light emitting surface of a light source, and drying such thermochromic material on such surface; whereby said thermochromic material then controls the quantity of light transmitted therethrough as a function of the temperature of said light source.

15. The method of claim 14, wherein said step of applying includes dipping.

16. The method of claim 14, wherein said step of applying includes spraying.

17. A strand of ornamental lights comprising:

a plurality of temperature responsive lamps including light source means for producing heat and light, and thermochromic means for transmitting light, the color of which is a function of the heat produced by such light source means and time; and a plurality of conductors for supplying electrical energy to said plurality of temperature responsive lamps.

18. The device of claim 17, including means for alternatingly enabling and interrupting the supply of electrical energy along said plurality of conductors.

19. The device of claim 18, wherein said plurality of temperature responsive lamps cool when such supply of electrical energy is interrupted and are operative to transmit colored light, the color of which changes over time, while such supply of electrical energy is enabled.

* * * * *